US005303635A

United States Patent [19]

Kowalczyk

[11] Patent Number: 5,303,635

[45] Date of Patent: Apr. 19, 1994

[54] APPARATUS AND METHOD FOR ENTRAPPING AND DISCARDING SPENT ARTILLERY SHELLS

[75] Inventor: Ronald B. Kowalczyk, Coeymans Hollow, N.Y.

[73] Assignee: The United States of America as represented by the Secretary of the Army, Washington, D.C.

[21] Appl. No.: 952,381

[22] Filed: Sep. 28, 1992

[51] Int. Cl.[5] ..... F41A 9/56

[52] U.S. Cl. ..... 89/33.4

[58] Field of Search ..... 42/25, 98; 89/33.01, 89/33.05, 33.4, 167, 186

[56] References Cited

U.S. PATENT DOCUMENTS 2,956,480 10/1960 Zouck ..... 89/33.4

4,738,182 4/1988 Nordmann ..... 89/33.4

*Primary Examiner*—Stephen C. Bentley

*Attorney, Agent, or Firm*—Anthony T. Lane; Edward Goldberg; Michael C. Sachs

[57] ABSTRACT

The present invention generally relates to a military cannon as typically mounted within the turret of a military armored vehicle such as an armored tank. My invention teaches method and apparatus for the catching and entrapping the stub case typically ejected from the breech of a military cannon after firing of an ammunition round. Subsequent to entrapment of the ejected stub case, the stub case catcher is raised to a preferred elevated angle simultaneously storing potential energy within a torsion bar which upon later release, ejects the entrapped stub case from the catcher and from the vehicle. By use of my invention and an automatic ammunition loader the crew requirements of such fighting vehicles may be reduced by eliminating the need for a human loader.

5 Claims, 10 Drawing Sheets

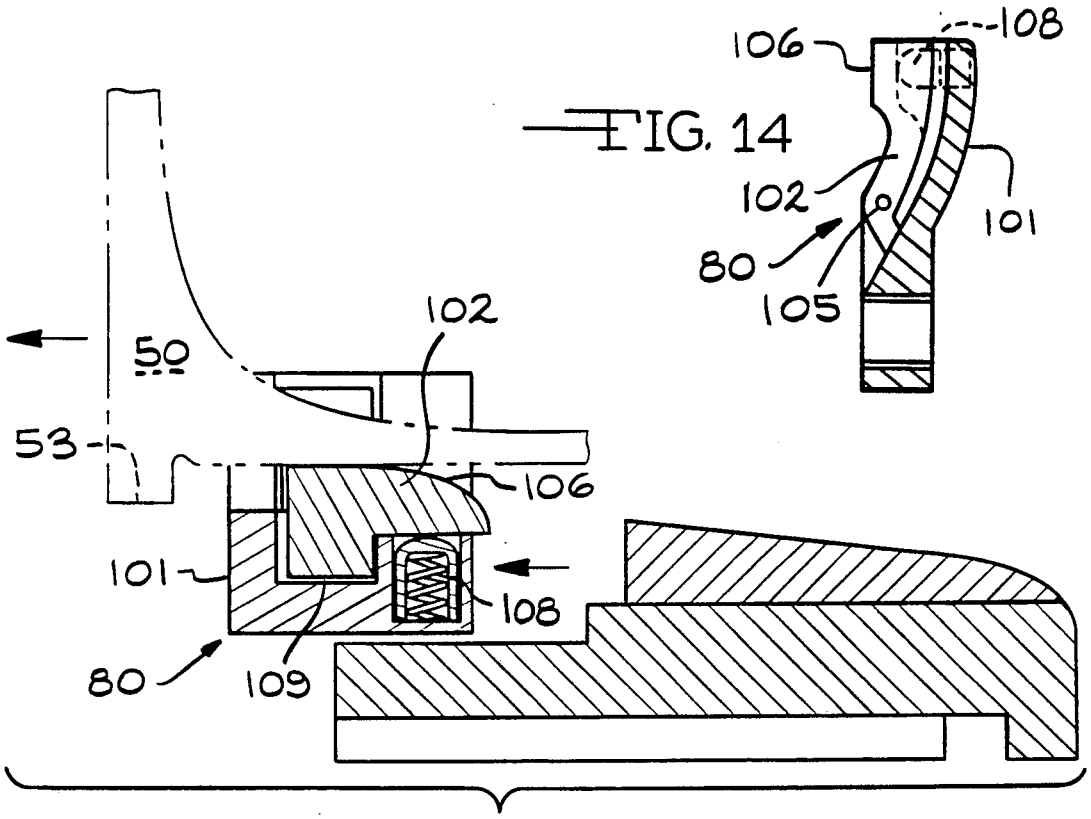
FIG. 14
FIG. 11C
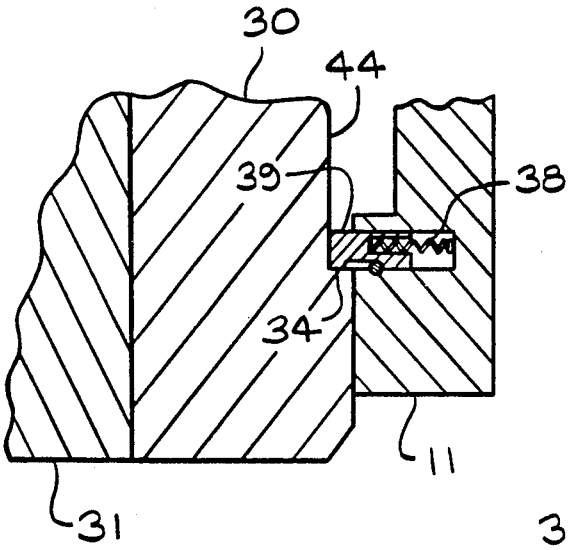
FIG. 12
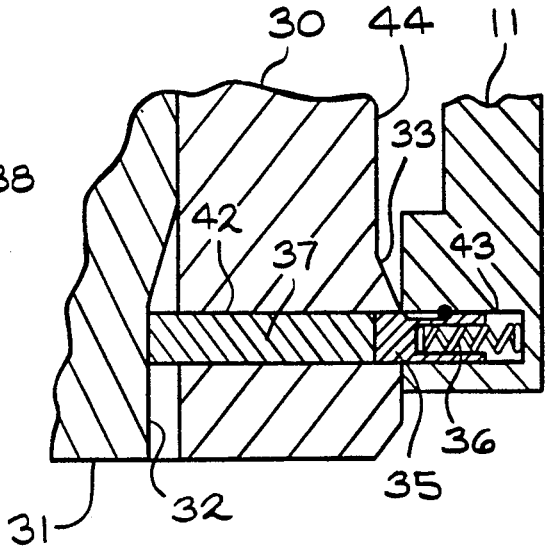
FIG. 13

APPARATUS AND METHOD FOR ENTRAPPING AND DISCARDING SPENT ARTILLERY SHELLS

The invention described herein may be manufactured, used and licensed by or for the Government for Governmental purposes without the payment to me of any royalties thereon.

BACKGROUND OF THE INVENTION

The present invention relates to a military tank/turret weapon system. At the present time a typical military tank combat crew consists of a tank commander, a driver, a gunner and an ammunition loader.

The tank commander is the officer in command of the fighting vehicle and responsible for coordinating the functions and activities of the other crew members to successfully complete the vehicle's assigned mission. The driver is responsible for the operation of the vehicle's engine systems and generally driving or otherwise maneuvering the vehicle. The gunner is responsible for operation of the vehicle's weapon systems, tracking and targeting of enemy vehicles and firing the on board weapon system thereby destroying enemy vehicles. The ammunition loader is responsible for physically selecting the particular type of ammunition ordered by the tank commander to be fired and manually loading the chosen ammunition into the weapon. Upon firing of the round, the round's cartridge case (stub case) is ejected by the weapon's breech mechanism with a force sufficient to propel the stub case toward the rear of the tank turret where it is generally received within a holding container. However, many times the stub case does not land within the holding container and the loader must manually capture the case and deposit it within the holding container. Further as the holding container fills with ejected casings, the loader must dispose of the spent casings by manually tossing the ejected stub cases outside the tank turret.

Future military tank cannon vehicle systems are being designed with a combat crew of three, the commander, driver, and gunner. The ammunition loader being replaced by an automated and mechanical loading device having a high rate of fire otherwise not achievable by a human loader. The stub case ejected from the weapon's breech must now be disposed of mechanically.

SUMMARY OF THE PRESENT INVENTION

The present invention teaches method and apparatus whereby the ammunition stub case, ejected from the breech of a tank turret cannon, may be safely and securely captured and subsequently ejected from the tank turret.

A stub case catcher mechanism is herein taught that receives and traps therein the ejected stub case ejected from the breech of a typical cannon type weapon system. The stub case catcher decelerates the stub case, absorbing it's kinetic energy thereby stopping the stub case and securing it within the catcher. Once secured within the catcher, the catcher is raised to an inclined position from which the stub case may be physically ejected from the tank turret. As the catcher is raised to the ejection position energy is stored within a torsion bar later to be released thereby providing the necessary force and energy for ejecting the stub case from the vehicle.

BRIEF DESCRIPTION OF THE DRAWINGS

FIG. 11C is a cross sectional view taken along line 11—11 of of FIG. 5 showing the stub case entrapment mechanism ejecting the captured stub case from the catcher.

FIG. 12 is a cross sectional view taken along line 12—12 of FIG. 1.

FIG. 13 is a cross sectional view taken along line 13—13 of FIG. 1.

FIG. 14 is an elevational view taken along line 14—14 of FIG. 11A.

DETAILED DESCRIPTION OF THE PREFERRED EMBODIMENT

Figure 1:
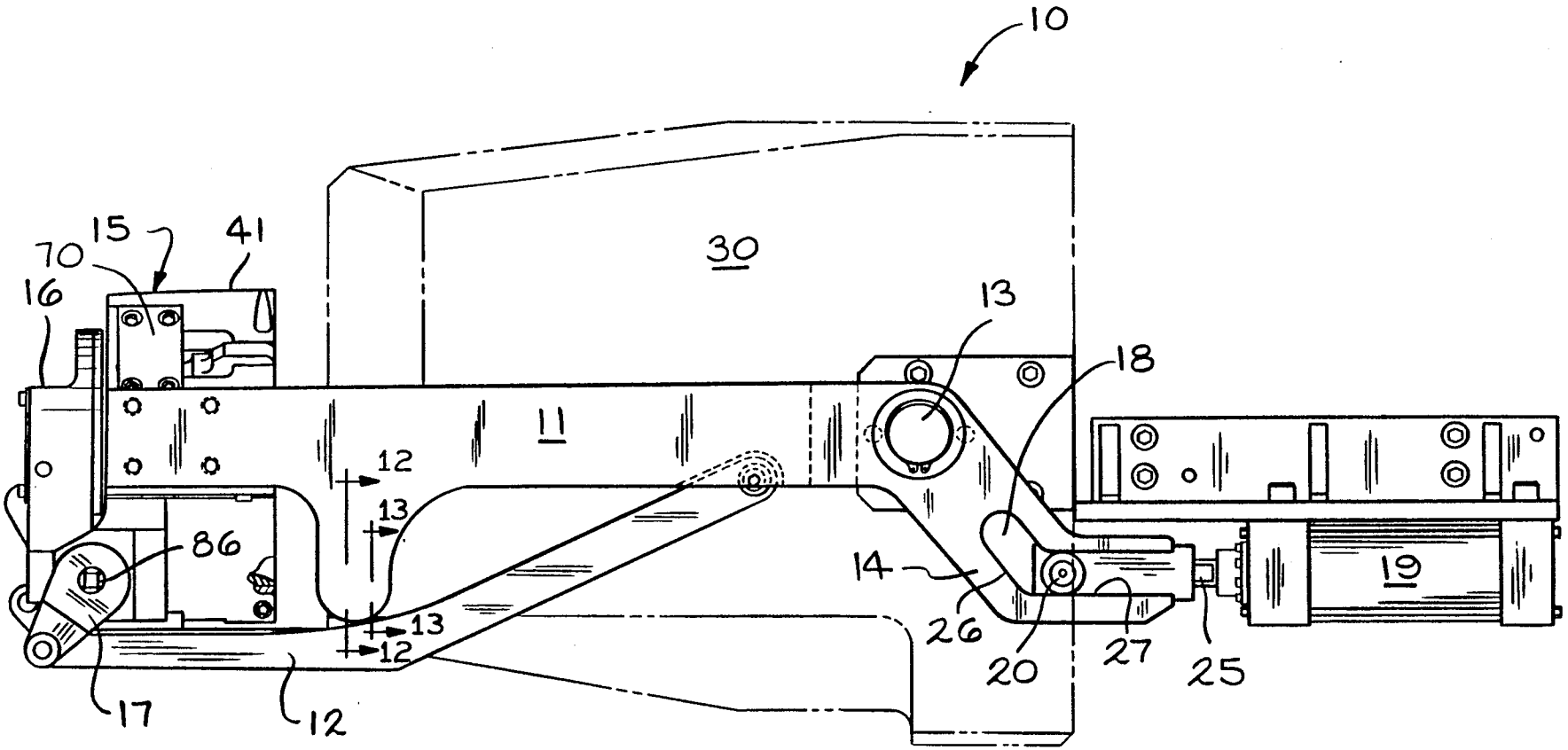
FIG. 1 is a right side elevational view of my stub case catcher as typically mounted upon the breech of a military cannon.
Figure 2:
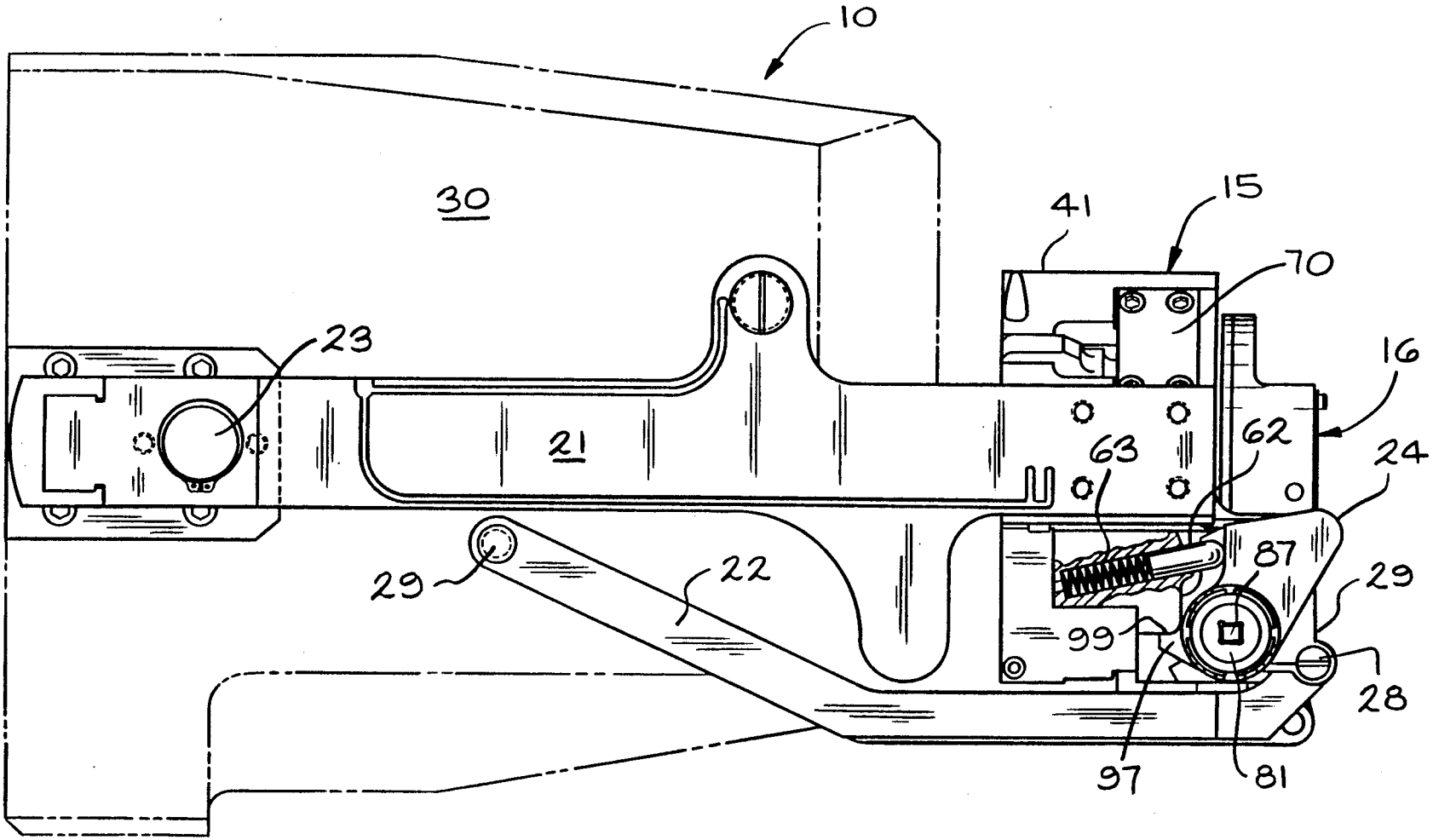
FIG. 2 is a left side elevational view of my stub case catcher.
Figure 3:
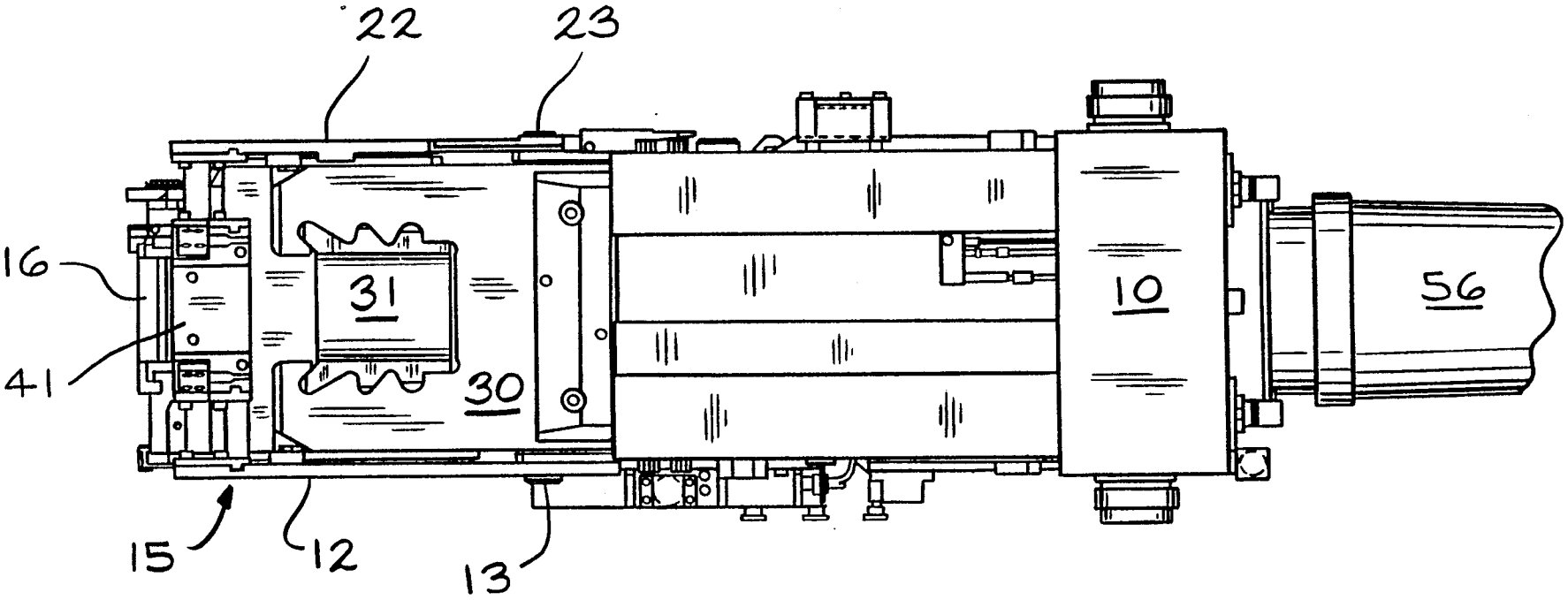
FIG. 3 is a top plan view showing my stub case catcher as attached to a typical weapon system.

Referring to FIGS. 1 through 3, a heavy cannon 10, as typically used in a modern day military tank, is partially shown having my stub case catcher mechanism 15 installed upon the breech 30 thereof. The catcher 15 basically comprises a trap housing 41 for trapping the stub case therein. The trap housing 41 is supported, to the rear of the breech 30, by lift arm 11 piviotly affixed to the right side of breech 30 by pivot 13 and locking arm 21 piviotly affixed to the left side of breech 30 by pivot 23. Lift arm 11, locking arm 21, and the centerline of trap assembly 15 are generally aligned with the centerline of barrel 56. Ejection door 16, closing off the rear opening of trap housing 41, is hingedly affixed to the catcher assembly 15 as described below.

Figure 4A:
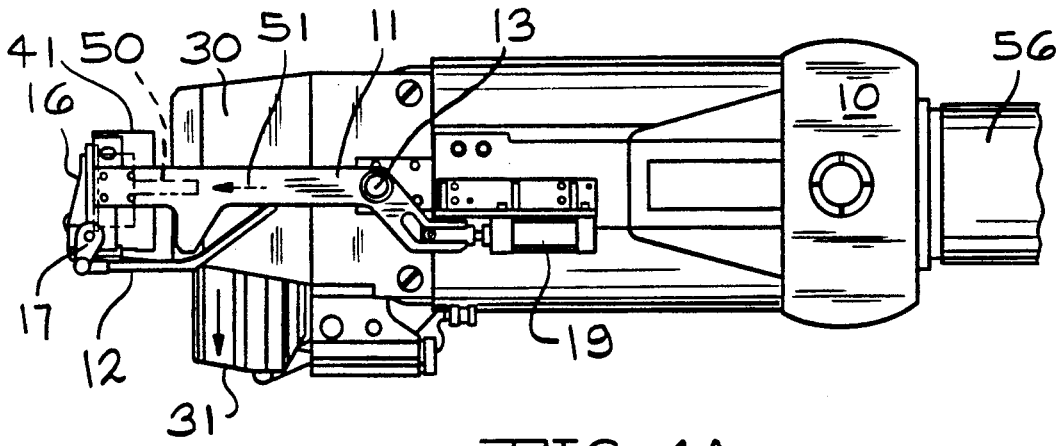
FIG. 4A illustrates my stub case catcher as mounted upon a typical cannon in the weapon firing position and ready to receive the stub case when ejected from the cannon breech.
Figure 4B:
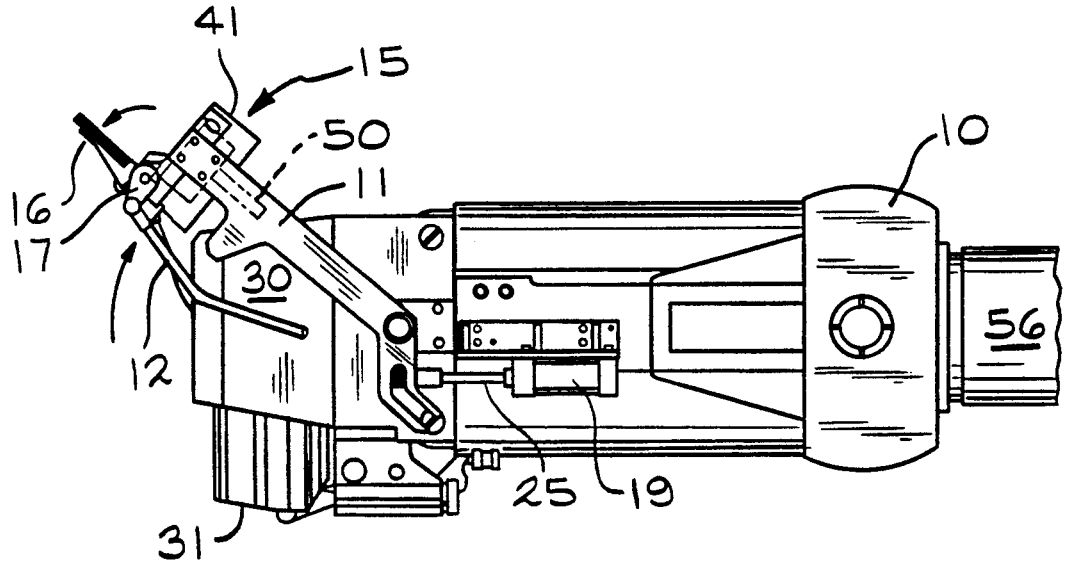
FIG. 4B illustrates the stub case catcher in its raised position subsequent to capturing therein a stub case ejected from the cannon breech.
Figure 4C:
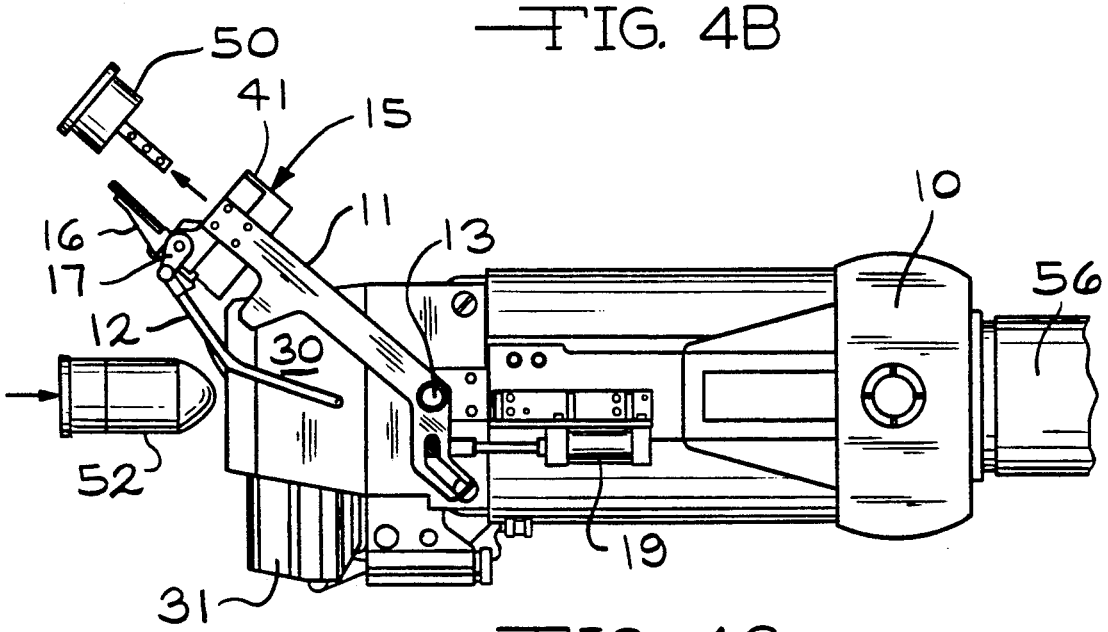
FIG. 4C illustrates the captured stub case being ejected from the stub case catcher and a new round of ammunition being simultaneously loaded into the cannon breech.

Referring now to FIG. 1, lift arm 11 is provided with an offset camming arm 14 having an offset camming slot 18 therein. Affixed generally to the frame of the weapon is hydraulic lifting cylinder 19 having a cam follower 20 attached to the cylinder's actuation rod 25. When cylinder 19 is hydraulically pressurized, rod 25 extends rearward (to the left as viewed in FIG. 1) advancing the cam follower 20 rearwardly into camming slot 18 until engagement with the slanted portion 26 of camming slot 18. As actuation rod 25 advances further, lift arm 11 is caused to pivot about pivot 13 and rise, as shown in FIG. 4B and 4C, thereby elevating catcher 15 above breech 30 thus permitting loading of an ammunition round into the cannon's breech. Similarly, as the activation rod 25 is retracted into cylinder 19 catcher 15 is lowered into alignment with breech 30. Because of the extremely high "G" loads created by the cannon's recoil action upon firing of a round, it is necessary that cylinder 19 be mounted to the weapon's frame. Thus the horizontal portion 27, of camming slot 18, permits axial translation of lift arm 11 with respect to cylinder 19 when cannon 10 recoils.

Referring now to FIG. 2. Ejection door 16 is provided with pivot 28 axially parallel to and spaced to the rear of the door hinge. Piviotly connected to pivot 28 is door activation link 22 having its opposite end thereof piviotly connected to breech 30 by pivot 29. As catcher 15 is raised, by action of hydraulic cylinder 19 described above, door link 22 causes clockwise rotation of ejection door 16 about its hinge centerline 60, thereby opening the rear of trap housing 41, as seen in FIGS. 4B and 4C, thus permitting ejection of the entrapped stub casing therein as will be subsequently described in greater detail below.

Having generally described the primary structure of my stub case catcher and now referring to FIGS. 4A, 4B, and 4C, the overall operational sequence will be described. FIG. 4A is intended to show my stub case catcher 15 in the weapon firing and stub case receiving position. The center line of catcher 15 is aligned with the weapon's barrel centerline (not shown) and is retained in this position during firing of the ammunition round and the resulting recoil of the weapon. Subsequent to firing of the ammunition round the stub case 50, shown in silhouette in FIGS. 4A and 4B, is ejected rearward from the breech 30, as depicted by arrow 51 and is caught and mechanically trapped within trap housing 41 as is described in greater detail below. The stub case enters the trap housing 41 with a significant amount of kinetic energy and is stopped by impacting against trap door 16. The kinetic energy of the stub case is thus absorbed and/or dissipated by transfer of the impacting force through pivot 28 and into door link 22 causing door link 22 to yield thereby absorbing the kinetic energy transfer from the stub case.

After the stub case 50 is secured within trap housing 41 hydraulic cylinder 19 is activated thereby raising catcher 15 to the position as shown in FIG. 4B. It is preferred that the angle between the catcher centerline and that of gun barrel 56 be within the range of 35 to 45 degrees, and most preferably 40 degrees.

Once catcher 15 is in the raised or eject position, as shown in FIG. 4B, stub case 50 is ejected from the catcher, through an appropriately aligned and open vehicle hatch (not shown). While in the raised position and before, during or after stub case ejection, a new ammunition round 52 is loaded into the cannon breech 30, preferably by an automatic ammunition loader. Subsequent to reloading of breech 30 and ejection of stub case 50 from catcher 15, hydraulic cylinder 19 is reverse activated thereby lowering the stub case catcher 15 to its firing position as shown in FIG. 4A and the cycle is repeated.

Because of the extremely high "G" loading experienced by cannon 10 during its recoil, it is desirable to rigidly affix the stub case catcher to breech 30 during firing and recoil of the weapon. FIG. 12 shows a cross section of a spring loaded stop pin positioned within the left lift arm 11. As the catcher is lowered from its raised position (FIG. 4B and 4C) into the firing position (FIG. 4A) stop pin 39, biased into sliding engagement with the external side wall 44 of breech 30 by compression spring 38, slides along wall 44 of breech 30 until contact is made with ledge 34 thereby stopping further downward travel of the catcher 15. Catcher 15 is now in the firing position.

Referring now to FIG. 13, it is also seen that as catcher 15 is lowered to the firing position, locking pin 35, also biased into sliding contact with the external wall 44 of breech 30 by compression spring 36, is caused to cam upon camming surface 33 thereby causing locking pin 35 to retract into bore 43 until aligned with bore 42 of breech 30. Locking pin 35 is then urged into bore 42 (as shown in FIG. 13) by action of compression spring 36 thereby locking lift arm 11, and catcher 15, to breech 30.

It is to be appreciated that a similar stop pin and locking pin mechanism is also provided on the left side of breech 30 thereby simultaneously locking lift arm 21 to breech 30. Thus by action of the two lift arm locking pins and pivots 13 and 23, catcher 15 is made fast to breech 30 for the recoil portion of the weapon firing sequence.

After the ammunition round is fired from the weapon, breech block 31 retracts downward from the breech (see FIGS. 4A, 4B, and 4C). As seen in FIG. 13 as breech block 31 translates downward camming surface 32 causes release pin 37 to retract into bore 42 thereby forcing locking pin 35 to retract into bore 43 thereby releasing lift arm 11.

Figure 5:
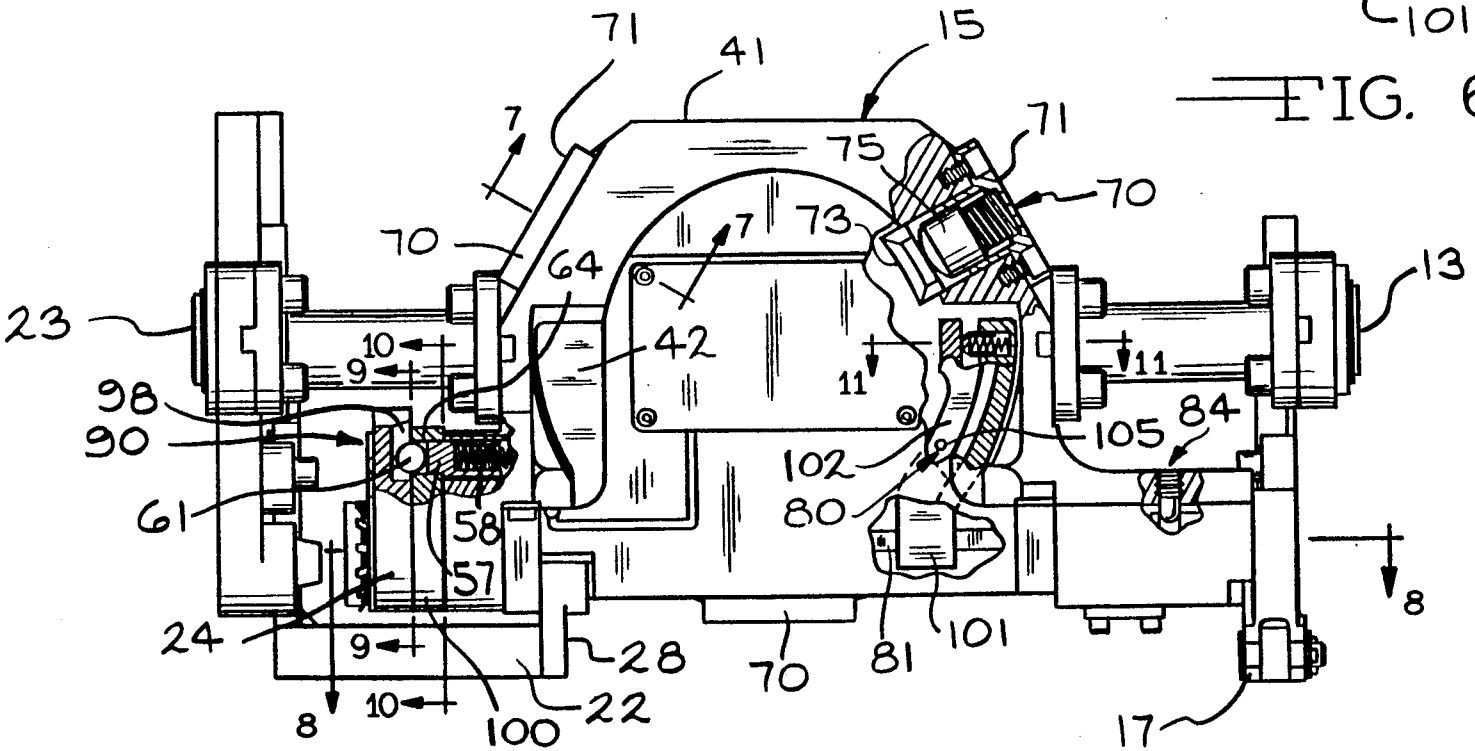
FIG. 5 elevational view of my stub case catcher showing the general cation of various mechanical subassemblies.

FIG. 5 presents an end elevation of the stub case catcher 15 assembly showing, in partial cutaway, the stub case alignment assembly 70, the stub case entrapment and ejection assembly 80, and the stub case ejection release mechanism 90.

Figure 7A:
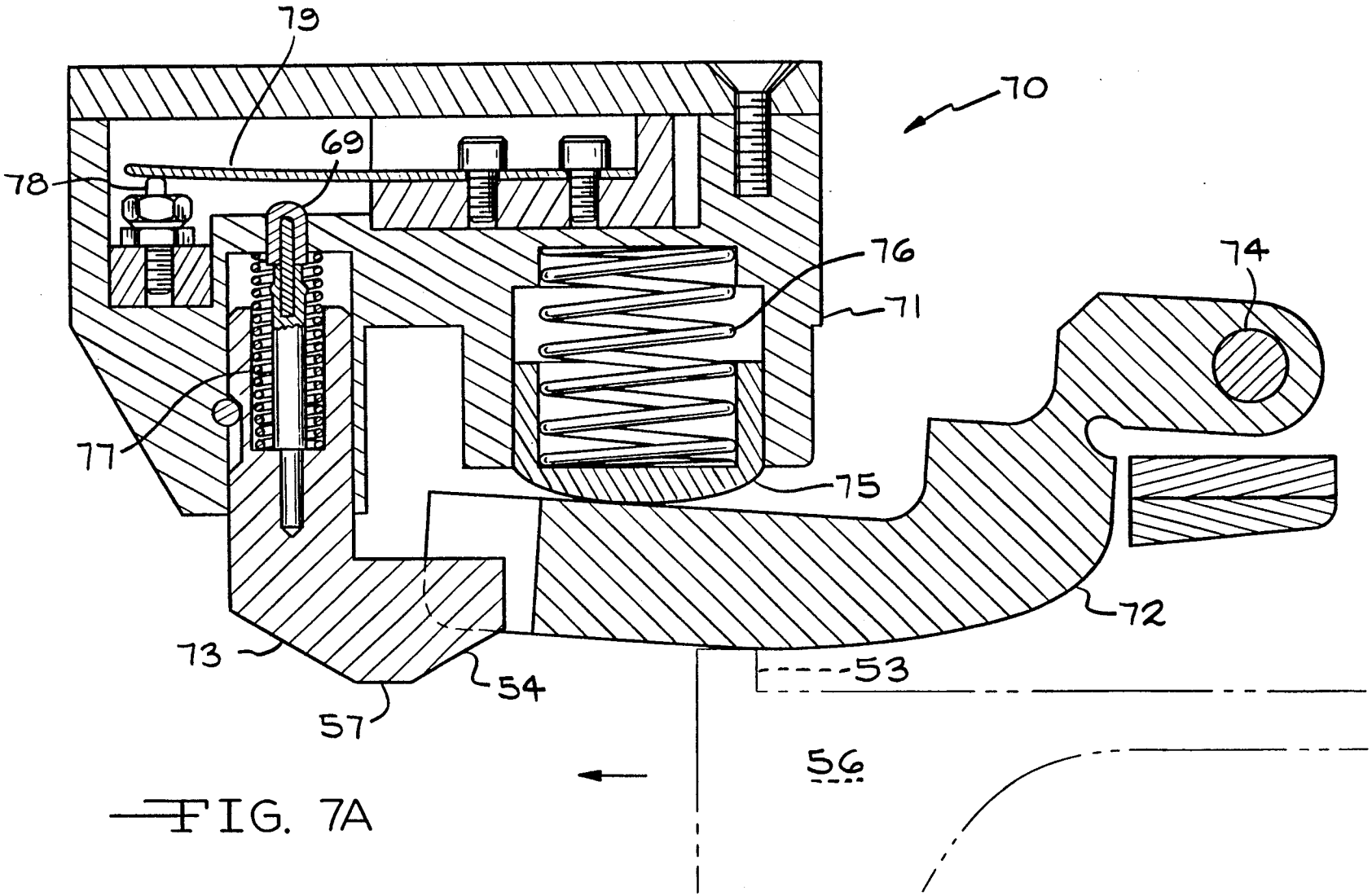
FIG. 7A is a cross sectional view taken along line 7—7 of FIG. 5 showing the stub case positioning mechanism prior to receiving therein a stub case ejected from the cannon breech.
Figure 7B:
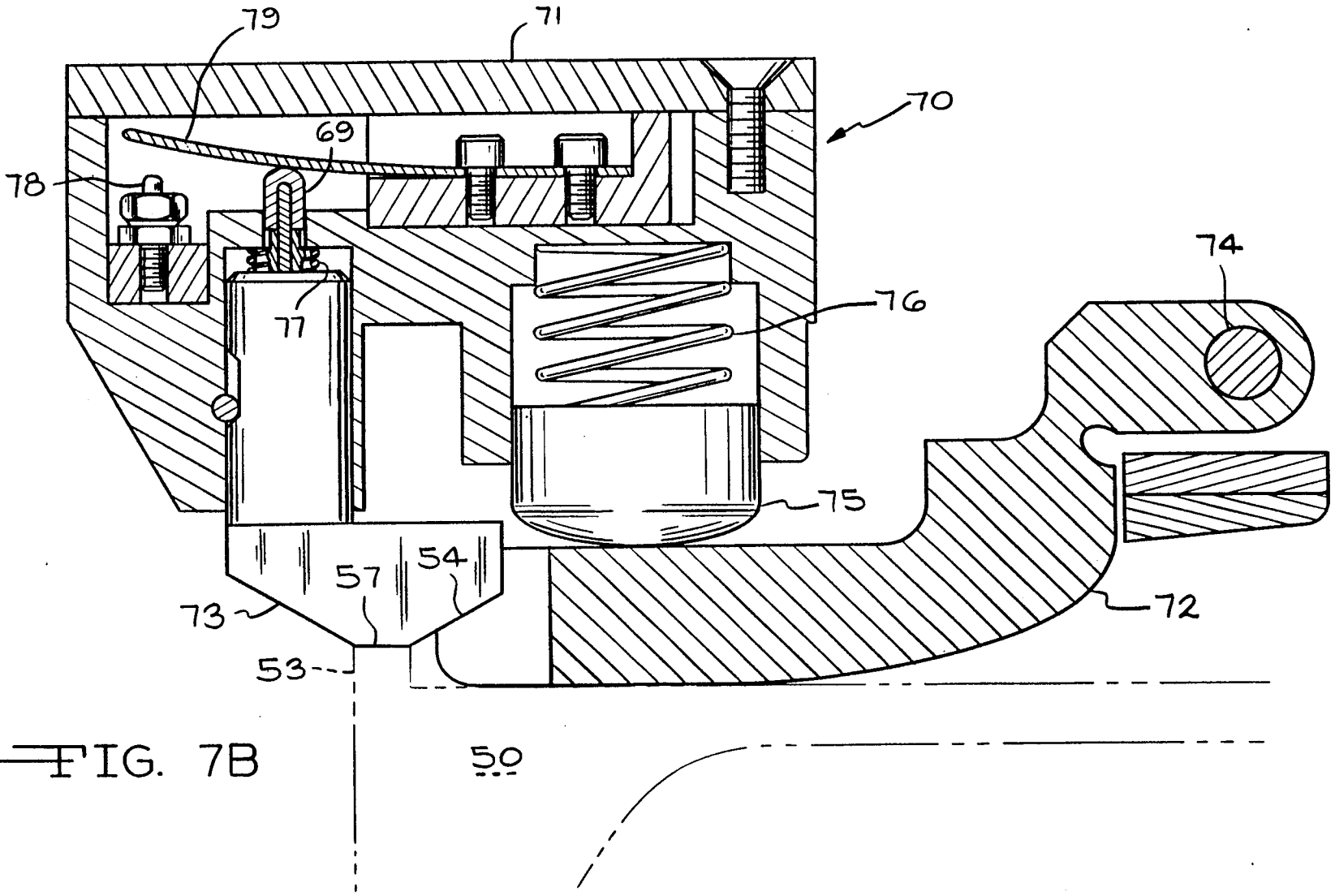
FIG. 7B is a sectional view taken along line 7—7 of FIG. 5 showing the stub case positioning mechanism after having received a stub case therein subsequent to ejection of the stub case from the cannon breech.

Referring to FIGS. 5, 7A and 7B, the catcher trap housing 41 is provided with three equally spaced stub case alignment mechanisms 70 as shown in FIGS. 7A and 7B. The alignment mechanisms 70 comprises a guide shoe 72 pivoted about pivot 74. Guide shoe 72 is biased radially inward toward the catcher centerline by compression spring 76 urging plunger 75 into contact with the guide shoe. Axially down stream (to the left in FIG. 7A) from guide shoe 72 is stub case centering cam 73 also biased radially inward toward the catcher centerline by compression spring 77. As stub case 50 enters the catcher housing 41, the three equally spaced guide shoes act to center the stub case within the trap housing 41 and align the stub case flange with the entrance ramp 54 of centering cam 73. As the stub case flange 53 proceeds rearward, stub case flange 53, acting upon the centering cam ramp 54, forces the centering cam into it's recess against compression spring 77. The rearward travel of stub case 50 is ultimately stopped by ejector door 16, as described above, thereby positioning stub case flange 57 upon centering cam 73 as shown in FIG. 7B. Stub case 50 is now centered within trap housing 41.

At least one of the three stub case alignment mechanisms further includes an electrical switch to signal a central controller that the stub case is properly positioned within catcher 15. FIGS. 7A and 7B show an electrical switch comprising a simple cantilevered spring steel switch arm 79 which is in electrical contact with terminal 78, as shown in FIG. 7A, when no stub case is present within the trap housing 41. When stub case 50 is positioned within trap housing 41, as shown in FIG. 7B, plunger assembly 69 acts against switch 79, breaking the electrical circuit with terminal 78 and thereby providing a signal that the stub case is positioned within the trap housing 41. By having three such switches it may be easily determined if the stub case is properly positioned for ejection or askew.

Figures 8, 9, 10, 15:
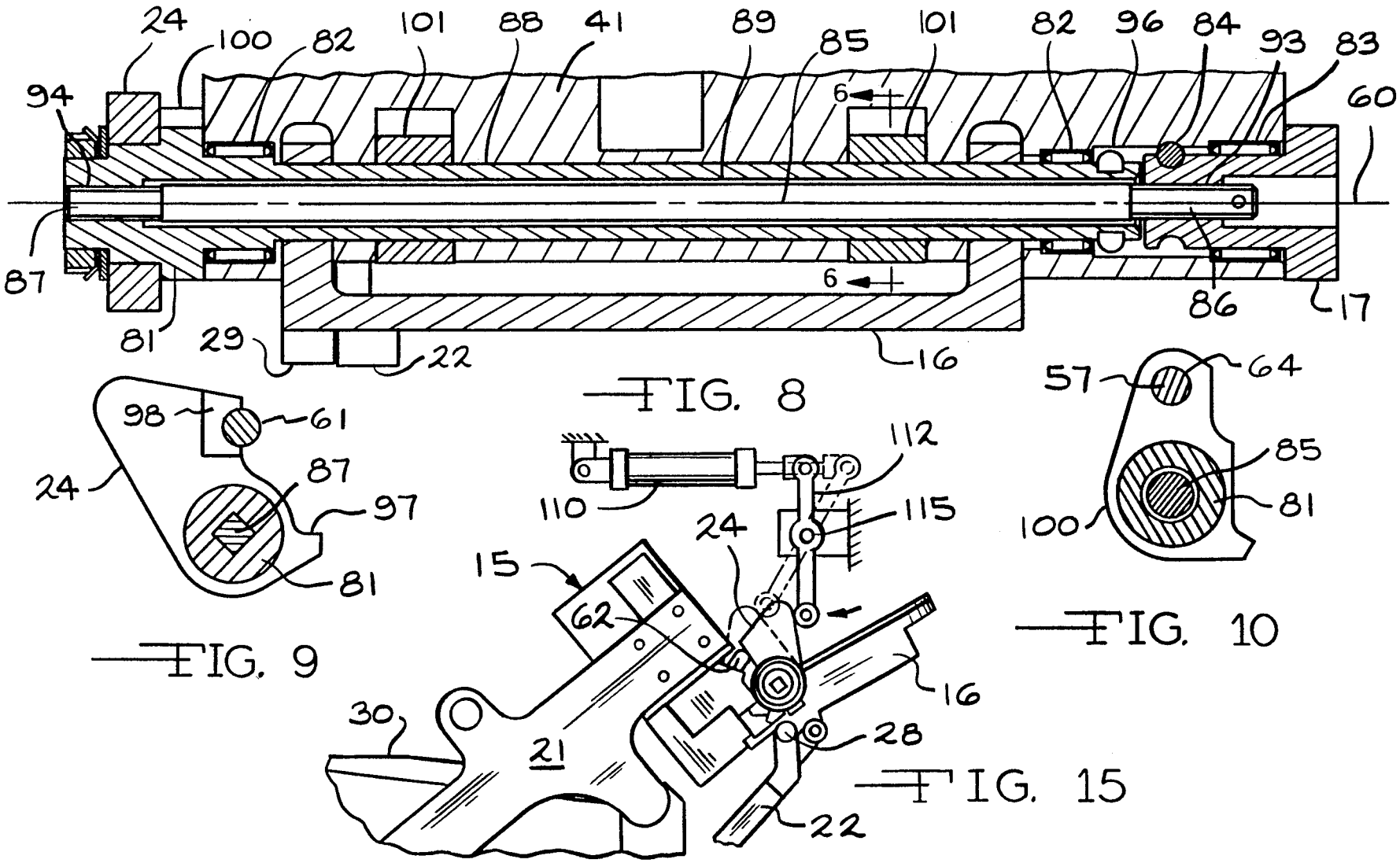
FIG. 8 is a cross sectional view taken along line 8—8 of FIG. 5 showing the torsion bar used to store energy for ejecting the captured stub case from the stub case catcher.
FIG. 9 is a cross sectional view as taken along line 9—9 of FIG. 5.
FIG. 10 is a cross sectional view taken along line 10—10 of FIG. 5.
FIG. 15 diagrammatically illustrates one simple mechanism for triggering the catcher's ejection mechanism for ejection of the stub case from the catcher.

Referring now to FIG. 8 presenting a cross sectional view as taken along line 8—8 of FIG. 5 showing the torque transfer shaft 81 which also acts as the hinge for rotation of ejection door 16 about door hinge center line 60. Transfer shaft 81 is journaled within bore 88, passing through trap housing 41, by bearings 82 positioned at each end thereof. Ejection door 16 is hinged about the torque transfer shaft 81 as shown in FIG. 8. Passing through bore 89 of torque transfer shaft 81 is torsion bar 85 having square end zones 86 and 87. Square end zones 86 and 87 are received within square bores 93 and 94 within torsion arm 17 and the torque transfer shaft 81 as shown in FIG. 8. Torsion arm 17 is received within bearing 83, as shown in FIG. 8 and is retained within bore 96 by action of retention pin 84; thus torsion bar 85 is free to thermally expand and contract in the axial direction.

It can now be appreciated that as the stub case catcher 15 is raised from the firing position, as shown in FIG. 4A, to the stub case rejection position, as shown in FIG. 4B by action of hydraulic cylinder 19, torsion bar 85 is torqued or twisted in the counter clockwise direction, as viewed in FIGS. 1, 4A, 4B, and 4C by action of the square ends 86 and 87 and torsion link 12, thereby storing potential energy therein. The square end 87 of torsion bar 85 and torque transfer shaft 81 are restricted from rotation as will be described below.

Referring now to FIGS. 2, 5, 8, 9 and 10, rotatably positioned upon the end of the torque transfer shaft 81 is trip cam 24 biased clockwise, as viewed in FIG. 2, by pin 62 and compression spring 63 within a convenient bore within trap housing 41. Maximum clockwise travel of trip cam 24 is checked by the action of tang 97 acting upon abutment 99 of trap housing 41. Trip cam 24 is free to rotate about the torque transfer shaft 81 and serves to release stored energy within torsion bar 85 for ejection of stub case 50 from catcher 15 as will be further described below.

Machined into the torque transfer shaft 81, as an integral part thereof and juxtaposed to trip cam 24, is torque release arm 100. Within the extended portion of torque release arm 100 is a cylindrical aperture 101 receiving therein plunger 57 biased to to the left, as viewed in FIG. 5, by compression spring 58 both of which are positioned within an appropriate bore within trap housing 41. Positioned axially in line with plunger 57 is camming ball 61 which is in rolling contact with cam surface 98 of trip cam 24. It can be appreciated, by reference to the figures, that as trip cam 24 is made to rotate counterclockwise, as viewed in FIG. 2, that camming ball 61 is thereby driven axially into aperture 64 driving plunger 57 axially into its bore. When the axial end of plunger 57 aligns with the surface or face of torque release arm 100 the torque release arm 100 is free to rotate relative to the trap housing 41 and trip cam 24. Thus torsion bar 85 is freed to rotate about its axis 60. By this release mechanism the energy stored within torsion bar 85 by raising the catcher 15 to its raised position, as shown in FIG. 4B may be released causing clockwise rotation of torque transfer shaft 81 as viewed in FIG. 2. This clockwise rotation of torque transfer shaft provides the motive force for ejection of the stub case as will be described below.

Figure 6:
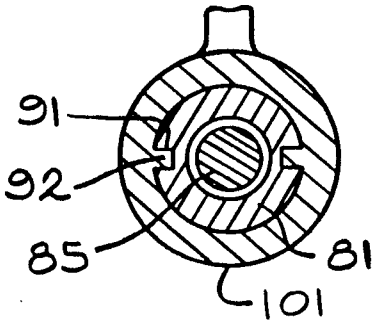
FIG. 6 is a sectional view taken along line 6—6 of FIG. 8.

Referring now to FIGS. 5, 6, 8, 11A through 11C and 14 showing details of the preferred stub case ejector mechanism 80. Ejector arm 101 is attached to the torque transfer shaft 81 by means of splines 92 projecting into groove 91 of torque transfer shaft 81 as shown in FIG. 6. Pivotly attached to ejector arm 101 by pivot 105 is ejector pawl 102 having a camming profile 106, best shown in FIG. 11A through 11C. Pawl 102 is biased radially inward, toward the weapon center line by compression spring 108 acting upon cap 107.

Figure 11A:
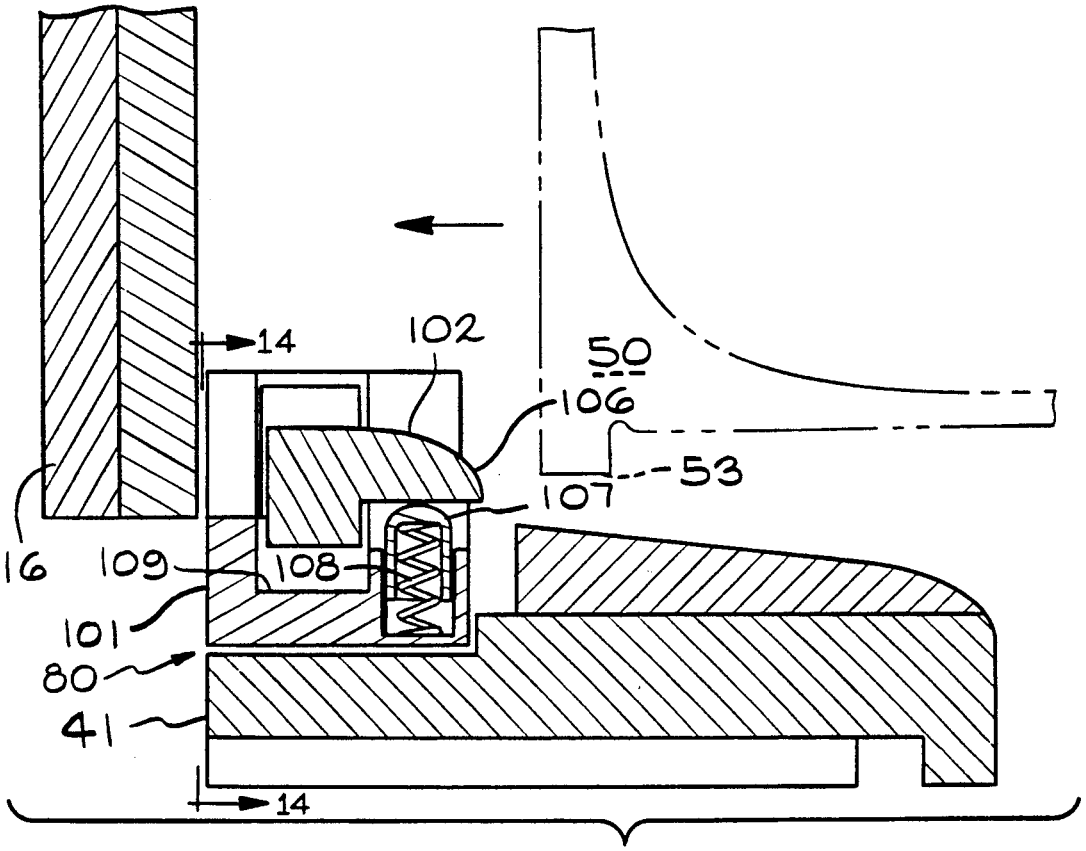
FIG. 11A is a cross sectional view taken along line 11—11 of FIG. 5 showing the stub case entrapment mechanism prior to receiving therein a stub case ejected from the cannon breech.
Figure 11B:
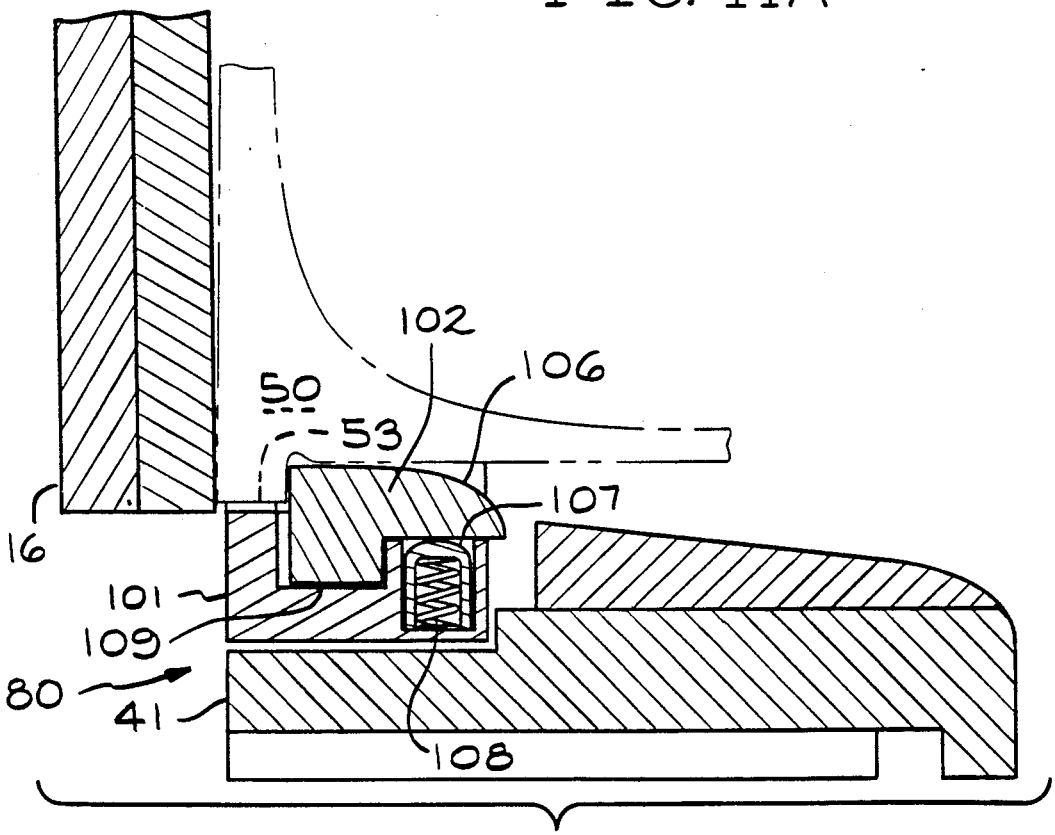
FIG. 11B is a cross sectional view taken along line 11—11 of FIG. 5 showing the stub case entrapment mechanism after having captured a stub case therein subsequent to ejection of the stub case from the cannon breech.

After firing of the ammunition round and ejection of stub case 50 from breech 30, stub case 50 enters catcher 15 and is centered by action of the stub case alignment mechanisms 70 as described above. Stub case 50 progresses rearward over the pawl camming profile 106 thereby forcing pawl 102 to retract, against the force of compression spring 108, into offset 109 of ejector arm 101 thereby permitting passage of flange 53. After passage of flange 53, compression spring 108, in combination with cap 107, causes pawl 102 to entrap the stub case 50 between pawl 102 and ejector door 16 as shown in FIG. 11B.

As catcher 15 is raised into the ejection position (FIG. 4B) torsion bar 85 is twisted thereby storing potential energy therein as described above. Upon release of torque transfer shaft 81 by action of trip cam 24, as described above, the potential energy stored within torsion bar 85 is transferred to torque transfer shaft 81 through square end 87 thereby causing the torque transfer shaft 81 to suddenly rotate counter clockwise, as viewed in FIGS. 9 and 10. As shown in FIG. 11C ejector arm 101 is thus caused to rotate in unison with the torque transfer shaft 81, to the left as viewed in FIG. 11C, thereby ejecting stub case 50 from catcher 15.

FIG. 15 illustrates a simple linkage mechanism for the activation of trip cam 24. Cylinder 110 affixed to the roof of the tank turret (not shown) is hydraulically activated thereby causing link 112 to pivot clockwise about pivot 115 thus rotating trip cam 24 counter clockwise thereby releasing the torque transfer shaft 81, as described above, resulting in ejection of the stub case trapped within the catcher as described immediately above.

In accordance with the provisions of the patent statutes, the principle and mode of operation of the invention have been illustrated and described in what is considered to represent its preferred embodiment. However, it should be understood that the invention can be practiced otherwise than as specifically illustrated and described without departing from its spirit or scope.

I claim:

1. In a military cannon wherein an ammunition stub case is ejected from the breech of said cannon after firing of an ammunition round, apparatus for capturing said stub case comprising:

a) main body means having a hollow cavity for receiving said stub case therein, said cavity having an axial centerline and opposite first and second openings at each end thereof, said hollow cavity centerline being axially aligned with the center line of said cannon whereby said first opening is adjacent the breech of said cannon, b) door means closing off the second opening of said hollow cavity, c) means within said hollow cavity for centering said stub case within said hollow cavity such that the axial center line of said stub case is coincident with the extended axial center line of said cannon, wherein said means for centering said stub case within said hollow cavity includes sensing means whereby the relative position of said stub case center line with respect to the center line of said cavity may be determined, d) means for securing said stub case within said hollow cavity, e) means for elevating said main body means at an angle of inclination with respect to the axial centerline of said cannon, f) means for ejecting said stub case from said hollow cavity when said main body is at said angle of inclination.

2. The apparatus as claimed in claim 1 wherein said sensing means includes means whereby the relationship of said stub case center line with respect to said cavity center line may be signaled to the weapon control means.

3. In a military cannon wherein an ammunition stub case is ejected from the breech of said cannon after firing of an ammunition round, apparatus for capturing said stub case comprising:

a) main body means having a hollow cavity for receiving said stub case therein, said cavity having an axial centerline and opposite first and second openings at each end thereof, said hollow cavity centerline being axially aligned with the center line of said cannon whereby said first opening is adjacent the breech of said cannon, b) door means closing off the second opening of said hollow cavity, c) means within said hollow cavity for centering said stub case within said hollow cavity such that the axial center line of said stub case is coincident with the extended axial center line of said cannon, d) means for securing said stub case within said hollow cavity, e) means for elevating said main body means at an angle of inclination with respect to the axial centerline of said cannon, f) means for ejecting said stub case from said hollow cavity when said main body is at said angle of inclination, said means for ejecting comprising means for storing the energy required to eject said stub case, said energy being imparted to said energy storage means by action of said main body rising to said inclined position.

4. The apparatus as claimed in claim 3 wherein said energy storage means includes a torsion bar mechanically linked to said stub case ejection means.

5. The apparatus as claimed in claim 4 wherein said torsion bar is orthogonal to said cannon center line, releasably fixed to said main body at one end thereof and having mechanical linkage means between the opposite end thereof and the breech of said cannon.

* * * * *